US008328326B2

(12) United States Patent
Inoue

(10) Patent No.: US 8,328,326 B2
(45) Date of Patent: Dec. 11, 2012

(54) INKJET RECORDING APPARATUS

(75) Inventor: Hiroshi Inoue, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 260 days.

(21) Appl. No.: 12/726,692

(22) Filed: Mar. 18, 2010

(65) Prior Publication Data

US 2010/0238234 A1 Sep. 23, 2010

(30) Foreign Application Priority Data

Mar. 19, 2009 (JP) ..... 2009-068555

(51) Int. Cl.
*B41J 2/165* (2006.01)

(52) U.S. Cl. ..... 347/33

(58) Field of Classification Search ..... None
See application file for complete search history.

(56) References Cited

U.S. PATENT DOCUMENTS

| | | | | |
|---|---|---|---|---|
| 7,219,976 | B2 * | 5/2007 | Mori et al. | 347/33 |
| 2004/0218002 | A1 | 11/2004 | Nakamura | |
| 2006/0238563 | A1 * | 10/2006 | Nakamura | 347/33 |
| 2008/0018677 | A1 | 1/2008 | White et al. | |
| 2008/0266342 | A1 | 10/2008 | Steinfield et al. | |
| 2009/0189945 | A1 * | 7/2009 | Sekiyama | 347/33 |

FOREIGN PATENT DOCUMENTS

| | | | |
|---|---|---|---|
| JP | 2005-212351 | A | 8/2005 |

* cited by examiner

*Primary Examiner* — Matthew Luu
*Assistant Examiner* — Alejandro Valencia
(74) *Attorney, Agent, or Firm* — Birch, Stewart, Kolasch & Birch, LLP

(57) ABSTRACT

The inkjet recording apparatus includes: an inkjet head having a nozzle surface in which inkjet nozzles are arranged, the nozzle surface being oblique to a horizontal plane; and a cleaner which wipes the nozzle surface. The cleaner includes: a supply spindle and a take-up spindle of which axes are horizontal; a band-shaped wiping member which is wound in a form of a roll and installed on the supply spindle, travels along a prescribed path of travel and is taken up onto the take-up spindle; a pressing roller of which axis is arranged in parallel with the nozzle surface, the wiping member being wrapped about a circumferential surface of the pressing roller; a front-stage guide device which is disposed between the supply spindle and the pressing roller and guides the wiping member supplied from the supply spindle so as to travel in a direction perpendicular to the axis of the pressing roller; and a rear-stage guide device which is disposed between the pressing roller and the take-up spindle and guides the wiping member wrapped about the pressing roller so as to travel in a direction perpendicular to the axis of the take-up spindle. The nozzle surface is cleaned by abutting the wiping member wrapped about the pressing roller against the nozzle surface.

12 Claims, 12 Drawing Sheets

INKJET RECORDING APPARATUS

BACKGROUND OF THE INVENTION

1. Field of the Invention

The present invention relates to an inkjet recording apparatus, and more particularly, to an inkjet recording apparatus provided with a cleaner which cleans the nozzle surface of a head in which the nozzle surface is disposed obliquely to the horizontal plane.

2. Description of the Related Art

In an inkjet recording apparatus, when a recording operation is carried out continuously, ink adheres and accumulates in the vicinity of the nozzles and blockages of the nozzles may occur. Then, cleaning of the nozzle surface is carried out periodically in the inkjet recording apparatus.

As a device for cleaning a nozzle surface (cleaner), Japanese Patent Application Publication No. 2005-212351 discloses a device which cleans and wipes away ink adhering to the nozzle surface by means of a travelling wiping member, by causing a travelling band-shaped wiping member which is wrapped about one axle (supply spindle) and another axle (take-up spindle) to abut against the nozzle surface of a head by means of a pressing roller.

However, in the cleaner in the related art, the supply spindle, the take-up spindle and the pressing roller are arranged mutually in parallel, and therefore if the head is disposed obliquely to the horizontal plane, the cleaner must also be disposed obliquely to the horizontal plane, which presents a drawback since a large installation space in the front/rear direction of the head becomes necessary.

Moreover, in order to lower the frequency of replacement of the wiping member, it is necessary to make the wiping member long, but lengthening the wiping member makes the diameter of the roll of the wiping member wrapped about the take-up spindle larger correspondingly, and this results in a drawback in that an even larger installation space becomes necessary.

Furthermore, in an inkjet recording apparatus which employs a drum conveyance method for conveying the recording medium (a method in which the recording medium is conveyed in rotation by being wrapped about the circumferential surface of a drum), since the heads of respective colors (for example, yellow, cyan, magenta and black) are inclined in mutually different directions about the circumferential surface of the drum, then if it is attempted to install cleaners in the related art in unmodified form, the cleaners will interfere with each other and therefore cannot be installed. If it is sought to avoid this, then the respective heads must be withdrawn by a large distance from the drum during cleaning, thus presenting a drawback in that the overall size of the apparatus becomes large.

SUMMARY OF THE INVENTION

The present invention has been contrived in view of these circumstances, an object thereof being to provide an inkjet recording apparatus whereby the frequency of replacement of a wiping member can be reduced, as well as being able to make the overall composition of the apparatus compact in size.

In order to attain the aforementioned object, the present invention is directed to an inkjet recording apparatus, comprising: an inkjet head having a nozzle surface in which inkjet nozzles are arranged, the nozzle surface being oblique to a horizontal plane; and a cleaner which wipes the nozzle surface and includes: a supply spindle and a take-up spindle of which axes are horizontal; a band-shaped wiping member which is wound in a form of a roll and installed on the supply spindle, travels along a prescribed path of travel and is taken up onto the take-up spindle; a pressing roller of which axis is arranged in parallel with the nozzle surface, the wiping member being wrapped about a circumferential surface of the pressing roller; a front-stage guide device which is disposed between the supply spindle and the pressing roller and guides the wiping member supplied from the supply spindle so as to travel in a direction perpendicular to the axis of the pressing roller; and a rear-stage guide device which is disposed between the pressing roller and the take-up spindle and guides the wiping member wrapped about the pressing roller so as to travel in a direction perpendicular to the axis of the take-up spindle, wherein the nozzle surface is cleaned by abutting the wiping member wrapped about the pressing roller against the nozzle surface.

According to this aspect of the present invention, the wiping member is pressed against the nozzle surface and wipes and cleans the nozzle surface by the pressing roller arranged in parallel with the nozzle surface of the inkjet head in which the nozzle surface is disposed at an inclination with respect to the horizontal plane. The wiping member is formed in a band shape, wound in the form of the roll and installed on the supply spindle. The supply spindle is arranged in parallel with the horizontal plane, and the travel direction of the wiping member supplied from the supply spindle is changed to a prescribed direction by the front-stage guide device so that the wiping member can be wrapped about the pressing roller. The travel direction of the wiping member having been wrapped about the pressing roller is changed to a prescribed direction by the rear-stage guide device so that the wiping member can be taken up onto the take-up spindle arranged in parallel with the horizontal plane. By thus composing the portion corresponding to the pressing roller so as to be inclined in accordance with the nozzle surface, it is possible to dispose the cleaner upright, even when cleaning the nozzle surface which is oblique to the horizontal plane. Thus, it is possible to reduce the installation space in the front/rear direction of the head, and therefore the whole of the inkjet recording apparatus can be made more compact. Furthermore, even if the wiping member has a large roll diameter, the required installation space in the front/rear direction of the head does not change, and therefore it is possible to use a wiping member having a large winding size (i.e., a long wiping member), thus reducing the frequency of replacement of the wiping member.

Preferably, the pressing roller is supported swingably within a plane perpendicular to the nozzle surface and follows the nozzle surface when abutted against the nozzle surface.

According to this aspect of the present invention, the pressing roller is supported swingably in the plane perpendicular to the nozzle surface. Thereby, it is possible to make the pressing roller follow the inclination of the nozzle surface, even if there is slight divergence between the inclination of the nozzle surface and that of the pressing roller, and therefore the wiping member can be made to contact the nozzle surface in a reliable fashion.

Preferably, the front-stage guide device includes a plurality of front-stage guide members about which the wiping member is wrapped, and guides the wiping member supplied from the supply spindle so as to travel in the direction perpendicular to the axis of the pressing roller while gradually changing a travel direction of the wiping member by the front-stage guide members, and the rear-stage guide device includes a plurality of rear-stage guide members about which the wiping member is wrapped, and guides the wiping member wrapped about the pressing roller so as to travel in the direction perpendicular to the axis of the take-up spindle while gradually changing the travel direction of the wiping member by the rear-stage guide members.

According to this aspect of the present invention, the front-stage guide device is constituted of the plurality of front-stage guide members about which the wiping member is wrapped, and by gradually changing the travel direction of the wiping member, guides the wiping member supplied from the horizontally disposed supply spindle so as to wrap about the circumferential surface of the pressing roller which is disposed at the inclination. Similarly, the rear-stage guide device is constituted of the plurality of front-stage guide members about which the wiping member wraps, and guides the wiping member having been wrapped about the pressing roller, which is disposed at the inclination, so as to be taken up on the horizontally disposed take-up spindle. Thus, the wiping member supplied from the horizontal supply spindle can readily be wrapped about the inclined pressing roller. Furthermore, the wiping member having been wrapped about the inclined pressing roller can be taken up readily onto the horizontal take-up spindle.

Preferably, the front-stage guide device includes: a first front-stage guide member, about which the wiping member is wrapped, and which changes the travel direction of the wiping member from a direction perpendicular to the axis of the supply spindle to a direction substantially perpendicular to the axis of the pressing roller; and a second front-stage guide member which is disposed between the first front-stage guide member and the pressing roller and guides the wiping member so as to wrap about the first front-stage guide member and the pressing roller, and the rear-stage guide device includes: a first rear-stage guide member, about which the wiping member is wrapped, and which changes the travel direction of the wiping member from a direction substantially perpendicular to the axis of the pressing roller to the direction perpendicular to the axis of the take-up spindle; and a second rear-stage guide member which is disposed between the first rear-stage guide member and the pressing roller and guides the wiping member so as to wrap about the first rear-stage guide member and the pressing roller.

According to this aspect of the present invention, the front-stage guide device is constituted of the first front-stage guide member and the second front-stage guide member, and the rear-stage guide device is constituted of the first rear-stage guide member and the second rear-stage guide member. Firstly, the travel direction of the wiping member supplied from the horizontal supply spindle is roughly changed by the first front-stage guide member. Thereupon, the travel direction is finely adjusted so that the wiping member can be wrapped about the pressing roller, by the second front-stage guide member. The travel direction of the wiping member having been wrapped about the pressing roller is changed by the first rear-stage guide member so that the wiping member can be taken up on the take-up spindle, but before this, the travel direction of the wiping member having been wrapped about the pressing roller is slightly changed by the second rear-stage guide member so that the wiping member can be wrapped about the first rear-stage guide member. Thus, it is possible to wrap the wiping member readily about the pressing roller by means of a minimum necessary number of guide members.

Preferably, each of the second front-stage guide member and the second rear-stage guide member is constituted of a guide roller having flanges, and skewed travel of the wiping member is prevented by engagement of edge portions of the travelling wiping member with the flanges.

According to this aspect of the present invention, the second front-stage guide member and the second rear-stage guide member are each constituted of the guide roller having the flanges. Skewed travel of the wiping member is prevented by means of the flanges engaging with the edges of the wiping member which travels by being wrapped about the second front-stage guide member and the second rear-stage guide member. Accordingly, the wiping member can be made to travel stably.

Preferably, a first structural body including the first front-stage guide member, the pressing roller and the first rear-stage guide member is arranged so as to be movable in a vertical direction relatively to a second structural body including the second front-stage guide member and the second rear-stage guide member; and the first structural body is arranged retractably to a prescribed retracted position from a prescribed use position with respect to the second structural body.

According to this aspect of the present invention, the first structural body composed of the first front-stage guide member, the pressing roller and the first rear-stage guide member is arranged so as to be movable in the vertical direction relatively to the second structural body composed of the second front-stage guide member and the second rear-stage guide member. In other words, it is possible to separate the second front-stage guide member and the second rear-stage guide member from the first front-stage guide member, the pressing roller and the first rear-stage guide member. Consequently, when replacing the wiping member, the wiping member can be wrapped easily about the respective members and the replacement task can be simply carried out.

Preferably, the inkjet recording apparatus further comprises: a rack which accommodates the cleaner and is set at a prescribed position in a main body of the inkjet recording apparatus, wherein when the cleaner is installed into the rack, an engaging section arranged in the rack engages with an engaged section linked to the first structural body to forcibly position the first structural body in the prescribed use position.

According to this aspect of the present invention, the cleaner is accommodated in the rack provided in the main body of the inkjet recording apparatus and set in the prescribed position in the inkjet recording apparatus. In this case, when the cleaner is installed into the rack, the engaging section provided in the rack engages with the engaged section linked to the first structural body, and the first structural body is thereby forcibly positioned in the prescribed use position. Thereby, the pressing roller can be registered easily in the prescribed installation position (the position where the pressing roller ought to be installed in the inkjet recording apparatus, this position being determined in accordance with the nozzle surface of the head that is to be cleaned). Furthermore, since the pressing roller is registered in position with reference to the rack arranged in the main body of the inkjet recording apparatus, then the pressing roller can be located in a uniform installation position at all times.

Preferably, the take-up spindle is coupled to a gear; and when the cleaner is installed in the rack, the gear of the take-up spindle engages with a drive gear arranged inside the rack and is caused to rotate by receiving drive force from the drive gear.

According to this aspect of the present invention, the gear for driving the take-up spindle to rotate is coupled to the take-up spindle. This gear engages with the drive gear arranged in the rack when the cleaner is accommodated in the rack. The gear of the take-up spindle is caused to rotate by receiving drive force from the drive gear. By thus separating the drive source, it is possible to simplify the composition of the cleaner.

Preferably, the supply spindle and the take-up spindle are disposed in parallel, one above the other, in positions vertically below the pressing roller.

According to this aspect of the present invention, the supply spindle and the take-up spindle are disposed in parallel, one above the other, in positions vertically below the pressing roller. Consequently, the cleaner can be made more compact in the breadthways direction.

Preferably, the inkjet recording apparatus further comprises: a drum which conveys a recording medium by rotation, wherein the inkjet head is disposed at a periphery of the drum, and the nozzle surface is then arranged obliquely to the horizontal plane.

According to this aspect of the present invention, the head is arranged at the periphery of the drum. Even in a case where a plurality of heads are arranged about the periphery of the drum in this way, in the present invention, it is possible to dispose the respective cleaners without interference therebetween, since the cleaners are made compact in size in the front/rear direction of the heads.

Preferably, the wiping member is wound on a winding core in the form of the roll, is installed on the supply spindle by mounting the winding core on the supply spindle, and is taken up onto a winding core which is mounted on the take-up spindle.

According to this aspect of the present invention, the wiping member is wound in the form of the roll on the winding core and is installed on the supply spindle by mounting the winding core on the supply spindle. Furthermore, the wiping member is taken up in the form of the roll on the winding core mounted on the take-up spindle. Thus, the task of replacing the wiping member can be easily carried out.

According to the present invention, it is possible to reduce the replacement frequency of the wiping member. Furthermore, it is possible to make the overall composition of the inkjet recording apparatus more compact in size.

DETAILED DESCRIPTION OF THE PREFERRED EMBODIMENTS

Composition of Inkjet Recording Apparatus (Image Formation Unit)

Figure 1:
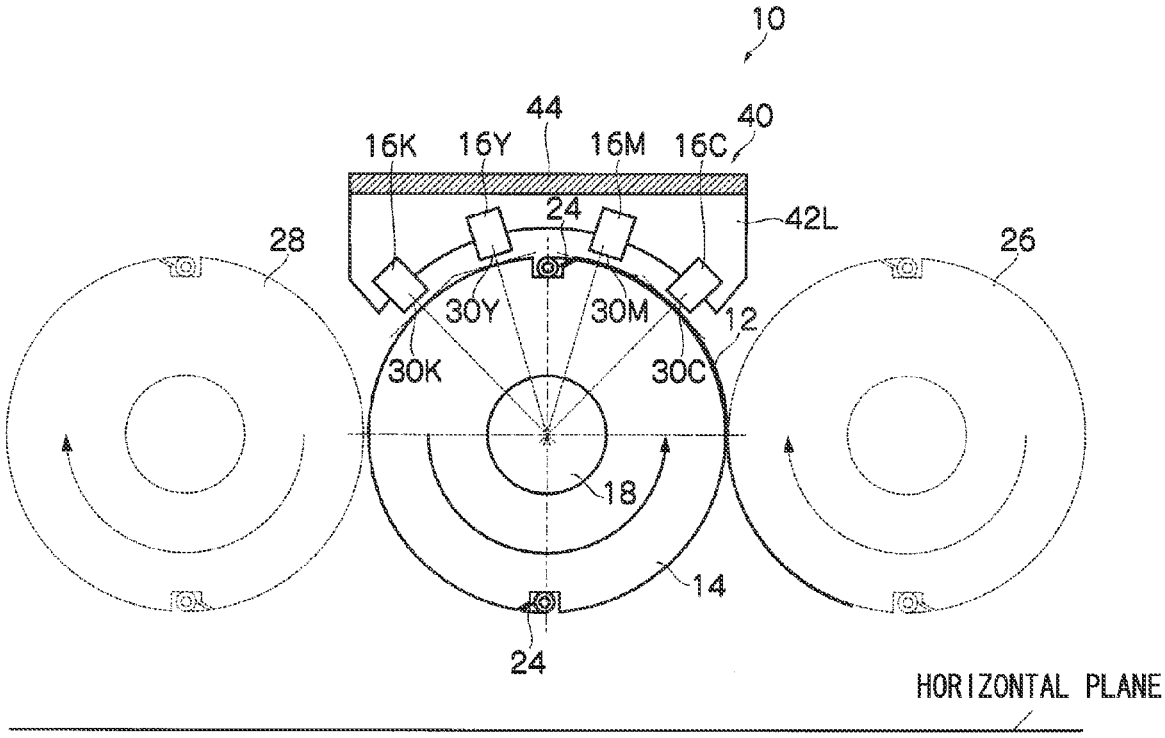
FIG. 1 is a side view diagram showing the general composition of an image formation unit of an inkjet recording apparatus according to an embodiment of the present invention.

FIG. 1 is a side view diagram showing the approximate composition of an image formation unit of an inkjet recording apparatus according to an embodiment of the present invention.

As shown in FIG. 1, in an image formation unit 10 of the inkjet recording apparatus according to the present embodiment, paper (recording medium) 12 is conveyed in rotation by being held by suction on the circumferential surface of an image formation drum 14. A color image is formed on a recording surface of the paper 12 by ejecting and depositing droplets of inks of respective colors of cyan (C), magenta (M), yellow (Y) and black (K) onto the recording surface of the paper 12 conveyed in rotation by the image formation drum 14, from four line inkjet heads 16C, 16M, 16Y and 16K, which are arranged about the periphery of the image formation drum 14.

The image formation drum 14 conveying the paper 12 in rotation is formed in a cylindrical shape and a rotating shaft 18 arranged so as to project from either end thereof is supported on bearings 22 arranged in a main frame 20 of the inkjet recording apparatus (see FIG. 2), whereby the image formation drum 14 is horizontally installed. A motor is coupled to the rotating shaft 18 through a rotation transmission mechanism (not illustrated), and the image formation drum 14 is driven by the motor to rotate.

The image formation drum 14 is provided with grippers 24 arranged on the circumferential surface thereof (in the present embodiment, at two locations on the outer circumferential surface thereof). The leading end portion of the paper 12 is gripped by the gripper 24 and thereby held on the outer circumferential surface of the image formation drum 14.

Moreover, a large number of suction holes (not illustrated) are formed in a prescribed arrangement pattern in the circumferential surface of the image formation drum 14, and air is sucked to the interior of the image formation drum 14 through the suction holes. The paper 12 wrapped about the circumferential surface of the image formation drum 14 is held by suction on the outer circumferential surface of the image formation drum 14 by the suction of air toward the interior of the image formation drum 14 through the suction holes.

In the inkjet recording apparatus according to the present embodiment, the paper 12 is transferred to the image formation drum 14 through a conveyance drum 26 from a previous step (for example, a step of depositing treatment liquid having a function of aggregating the coloring material in the ink onto the recording surface of the paper 12). The conveyance drum 26 is disposed in parallel with the image formation drum 14 and transfers the paper 12 onto the image formation drum 14 in a synchronized fashion.

Furthermore, the paper 12 after the image formation is transferred to a subsequent step (for example, a step of drying the ink) through a conveyance drum 28. The conveyance drum 28 is disposed in parallel with the image formation drum 14 and receives the paper 12 from the image formation drum 14 in a synchronized fashion.

The four line heads 16C, 16M, 16Y and 16K have widths corresponding to the paper width, and are arranged at uniform intervals apart radially on a circle concentric with the rotating shaft 18 of the image formation drum 14.

In the present embodiment, the four lines heads 16C, 16M, 16Y and 16K are arranged symmetrically about the image formation drum 14. In other words, the cyan line head 16C and the black line head 16K are disposed symmetrically with respect to the vertical line that passes through the center of the image formation drum 14, and the magenta line head 16M and the yellow line head 16Y are also disposed symmetrically with respect to the same vertical line.

Nozzle surfaces 30C, 30M, 30Y and 30K of the inkjet heads 16C, 16M, 16Y and 16K, which are disposed as described above, are positioned so as to face the outer circumferential surface of the image formation drum 14, and the nozzle surfaces 30C, 30M, 30Y and 30K are disposed at a prescribed height position from the outer circumferential surface of the image formation drum 14 (a uniform gap is formed between the outer circumferential surface of the image formation drum 14 and each of the nozzle surfaces 30C, 30M, 30Y and 30K). Furthermore, inkjet nozzles are formed in the nozzle surfaces 30C, 30M, 30Y and 30K, and are arranged in rows perpendicular to the conveyance direction of the paper 12.

Ink droplets are ejected perpendicularly toward the outer circumferential surface of the image formation drum 14 from the inkjet nozzle rows, which are formed in the nozzle surfaces 30C, 30M, 30Y and 30K of the lines heads 16C, 16M, 16Y and 16K disposed as described above.

The image formation unit 10 has the composition described above. In the image formation unit 10, the paper 12 is received onto the image formation drum 14 from the previous step through the conveyance drum 26, and is conveyed in rotation while being held by suction on the circumferential surface of the image formation drum 14. The paper 12 passes below the line heads 16C, 16M, 16Y and 16K during this conveyance and ink droplets are ejected and deposited from the line heads 16C, 16M, 16Y and 16K onto the recording surface of the paper 12 as the paper 12 passes, thereby forming a color image on the recording surface of the paper 12. After having completed the image recording, the paper 12 is transferred from the image formation drum 14 to the conveyance drum 28 and is conveyed to the subsequent step.

Figure 2:
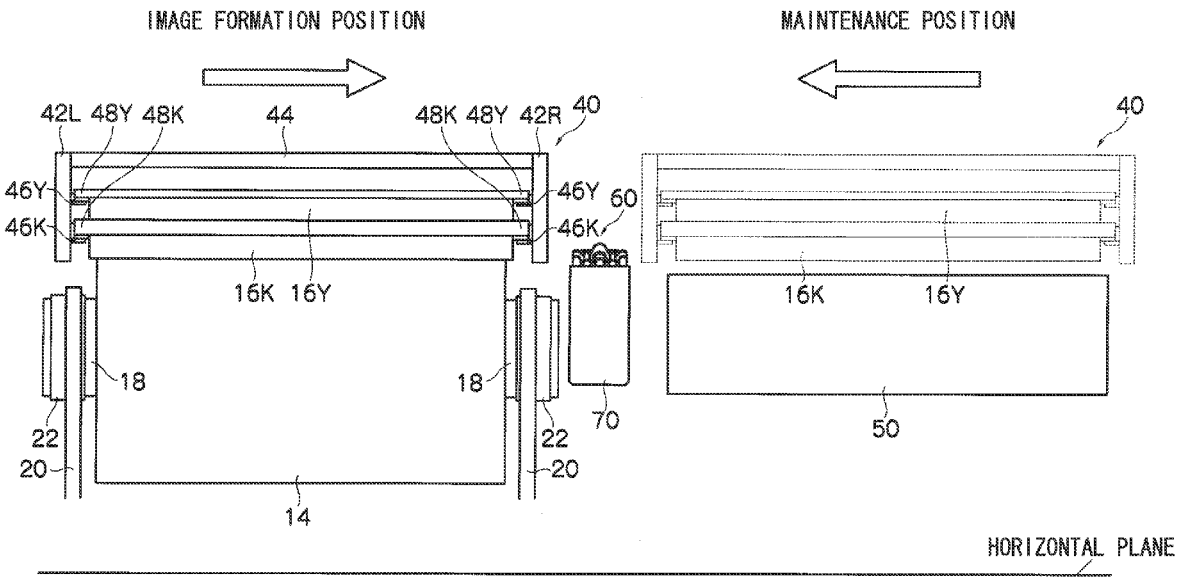
FIG. 2 is a front view diagram of the image formation unit of the inkjet recording apparatus.

In the image formation unit 10 having the composition described above, the line heads 16C, 16M, 16Y and 16K are installed on a head supporting frame 40 as shown in FIG. 2.

The head supporting frame 40 is constituted of a pair of side plates 42L and 42R, which are arranged perpendicularly to the rotating shaft 18 of the image formation drum 14, and a linking frame 44, which links the pair of side plate 42L and 42R together at the upper end portions thereof.

Each of the side plates 42L and 42R is formed in a plate shape, and the side plates 42L and 42R are disposed so as to face to each other across the image formation drum 14. Installation sections 46C, 46M, 46Y and 46K for installing the respective line heads 16C, 16M, 16Y and 16K are provided on the inner side faces of the pair of side plates 42L and 42R (only the installation sections 46Y and 46K are depicted in FIG. 2).

Installation sections 46C, 46M, 46Y and 46K are disposed at a uniform spacing apart radially on a circle concentric with the rotating shaft 18 of the image formation drum 14. The line heads 16C, 16M, 16Y and 16K are installed on the head supporting frame 40 by fixing attachment sections 48C, 48M, 48Y and 48K, which are formed on the respective ends of the heads (only the attachment sections 48Y and 48K are depicted in FIG. 2) onto the installation sections 46C, 46M, 46Y and 46K. By installing the line heads 16C, 16M, 16Y and 16K on the head supporting frame 40, the line heads 16C, 16M, 16Y and 16K are disposed at uniform intervals apart radially on a circle concentric with the rotating shaft 18 of the image formation drum 14.

The head supporting frame 40 for installing the line heads 16C, 16M, 16Y and 16K is arranged slidably in a direction parallel to the rotating shaft 18 of the image formation drum 14 (a horizontal direction) by being guided by guide rails (not illustrated). The head supporting frame 40 is arranged movably between an "image formation position" indicated by the solid lines in FIG. 2 and a "maintenance position" indicated by the dotted lines in FIG. 2, by being driven by a linear drive device (not illustrated).

When the head supporting frame 40 is disposed in the image formation position, the line heads 16C, 16M, 16Y and 16K are disposed about the periphery of the image formation drum 14 and assume a state capable of image formation.

On the other hand, when the head supporting frame 40 is disposed in the maintenance position, the line heads 16C, 16M, 16Y and 16K are retracted from the image formation drum 14. A moisturizing unit 50 for moisturizing the line heads 16C, 16M, 16Y and 16K is arranged in the maintenance position. When the line heads 16C, 16M, 16Y and 16K are not used for a long time, the head supporting frame 40 is placed in the maintenance position and the line heads 16C, 16M, 16Y and 16K are moisturized by the moisturizing unit 50. Thereby, ejection failure due to drying is prevented.

A head cleaning unit 60 for cleaning the nozzle surfaces 30C, 30M, 30Y and 30K of the line heads 16C, 16M, 16Y and 16K is arranged between the image formation position and the maintenance position. When the line heads 16C, 16M, 16Y and 16K are moved from the image formation position to the maintenance position, wiping webs are abutted and pressed against the nozzle surfaces 30C, 30M, 30Y and 30K, whereby the nozzle surfaces 30C, 30M, 30Y and 30K are wiped and cleaned. Below, the composition of the head cleaning unit 60 will be described.

Composition of Head Cleaning Unit

Figure 3:
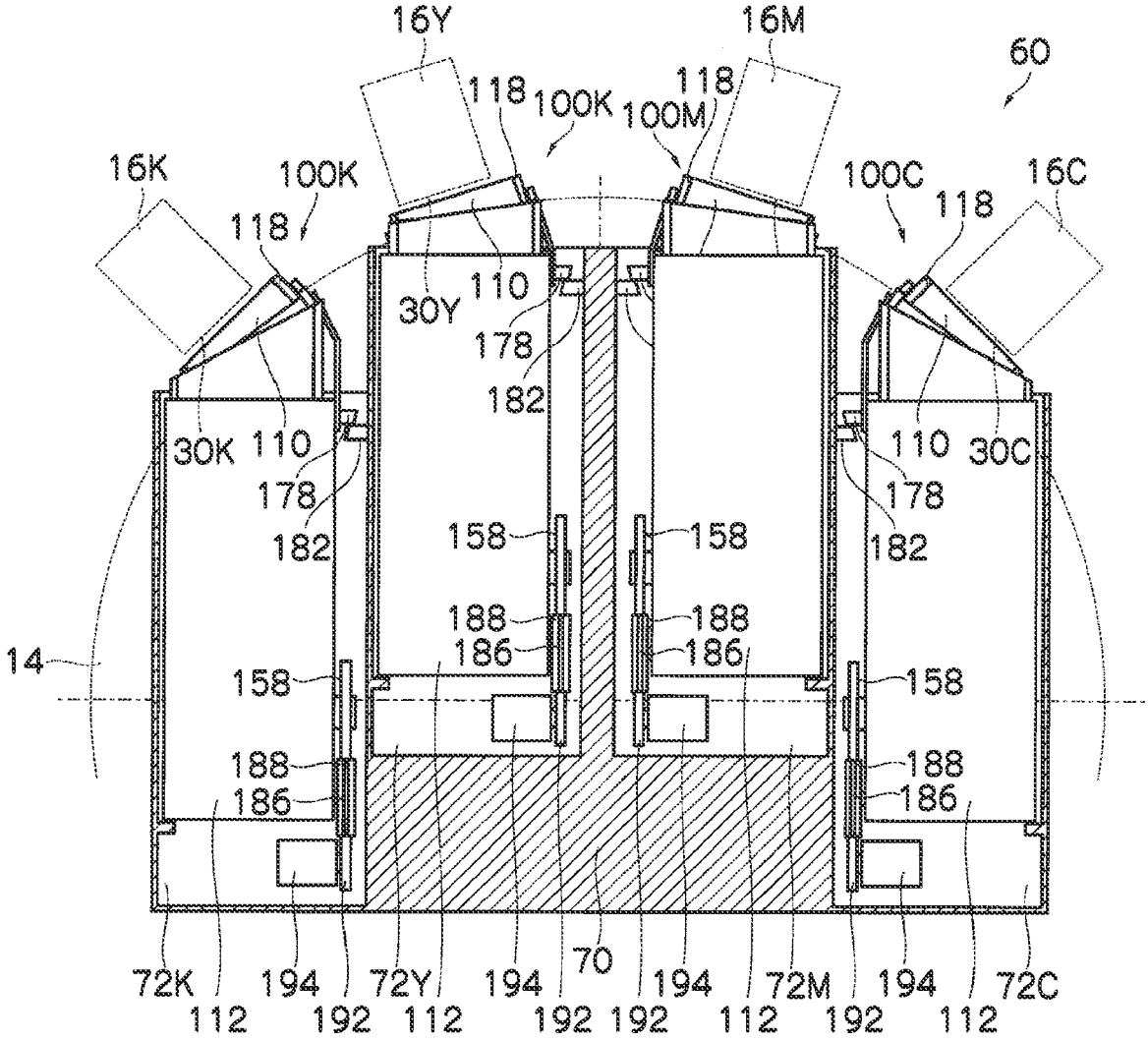
FIG. 3 is a side view diagram showing the composition of a head cleaning unit.

FIG. 3 is a side view diagram showing the composition of the head cleaning unit 60. As shown in FIG. 3, the head cleaning unit 60 is constituted of cleaners 100C, 100M, 100Y and 100K disposed so as to correspond respectively to the line heads 16C, 16M, 16Y and 16K, and a rack 70, in which these cleaners 100C, 100M, 100Y and 100K are set.

The rack 70 is formed in a box shape having an open upper end portion, and installation sections 72C, 72M, 72Y and 72K for installing the cleaners 100C, 100M, 100Y and 100K are arranged inside the rack 70. The cleaners 100C, 100M, 100Y and 100K are set in the respective installation sections 72C, 72M, 72Y and 72K by being inserted vertically downwards through the upper end openings of the installation sections 72C, 72M, 72Y and 72K.

The rack 70 is supported to on an elevator device (not illustrated), which is provided on the main frame 20 of the inkjet recording apparatus, and can be vertically raised and lowered with respect to the horizontal plane.

Composition of Cleaner

Next, the composition of the cleaners 100C, 100M, 100Y and 100K will be described.

The cleaners 100C, 100M, 100Y and 100K all have the same basic composition and therefore the composition is described here with respect to one cleaner 100.

Figure 4:
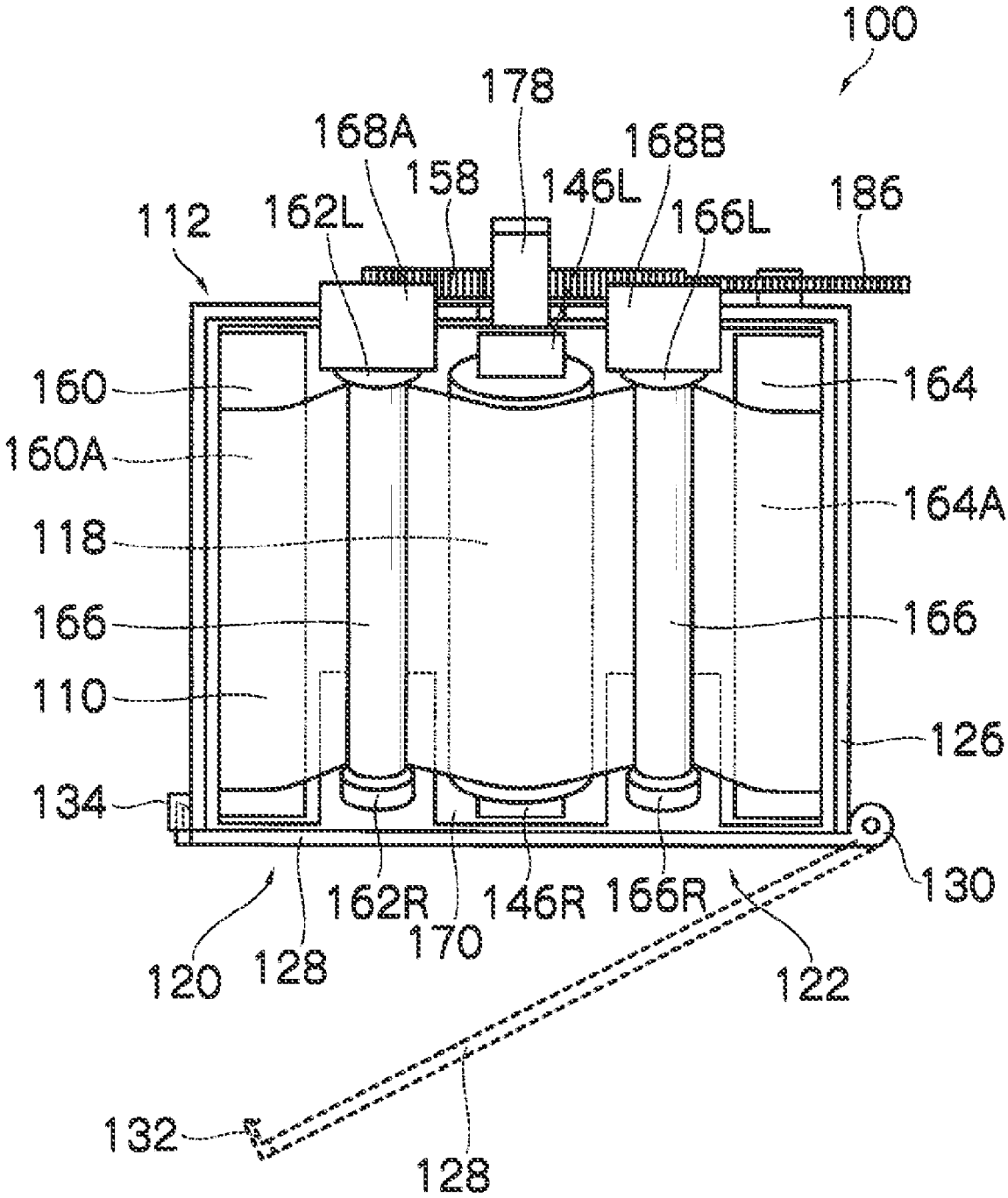
FIG. 4 is a plan diagram of a cleaner.
Figure 5:
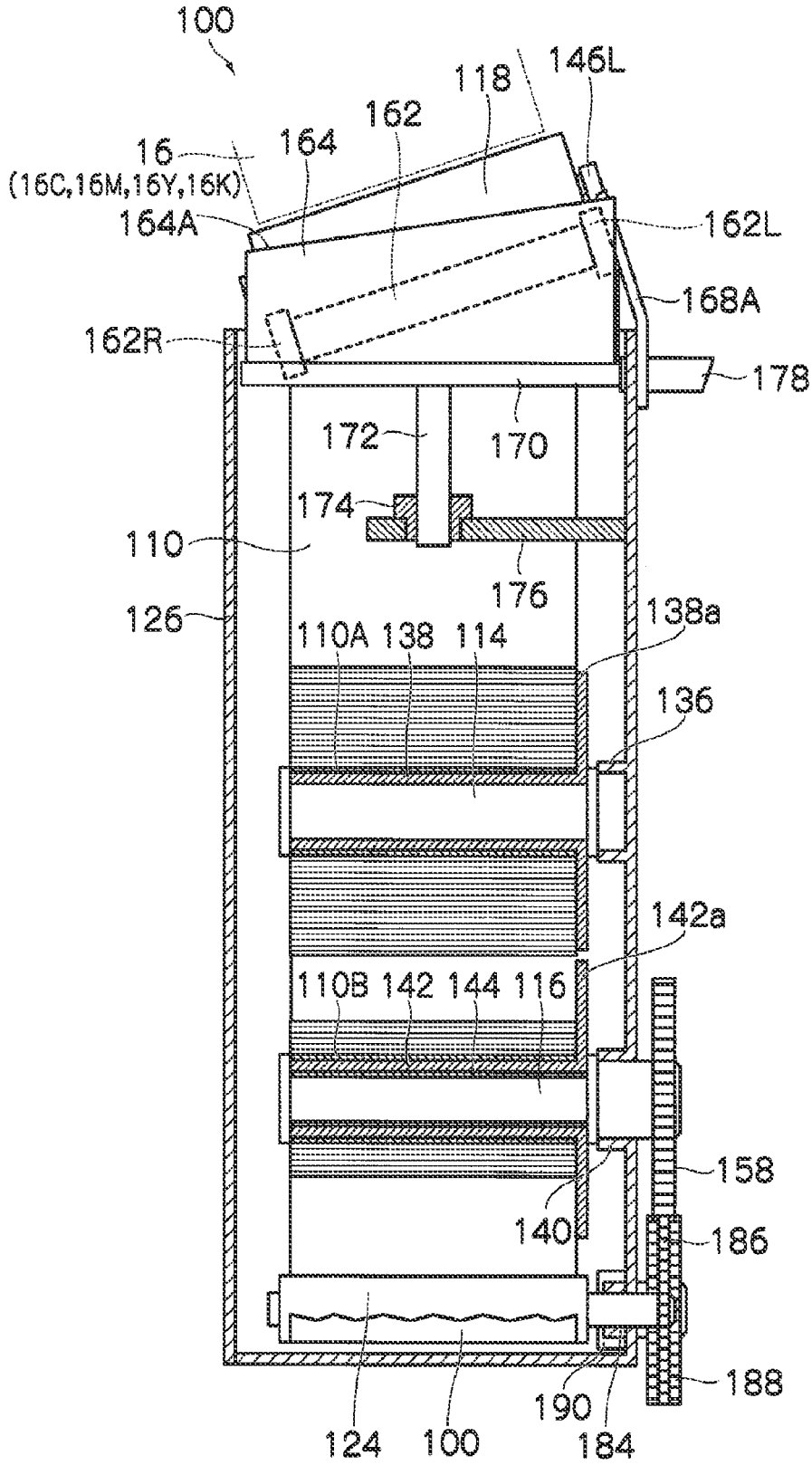
FIG. 5 is a cross-sectional partial side view of the cleaner.
Figure 6:
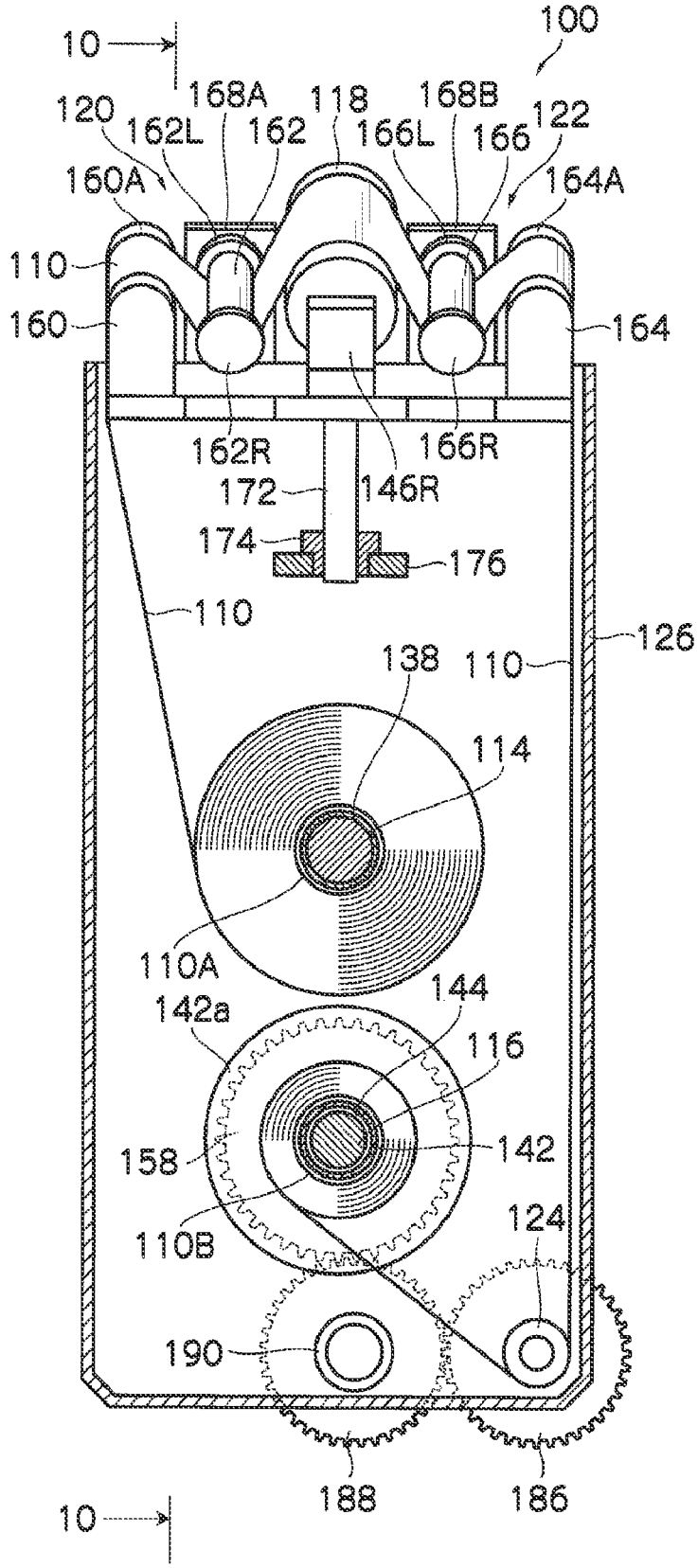
FIG. 6 is a cross-sectional partial front view of the cleaner.
Figure 7:
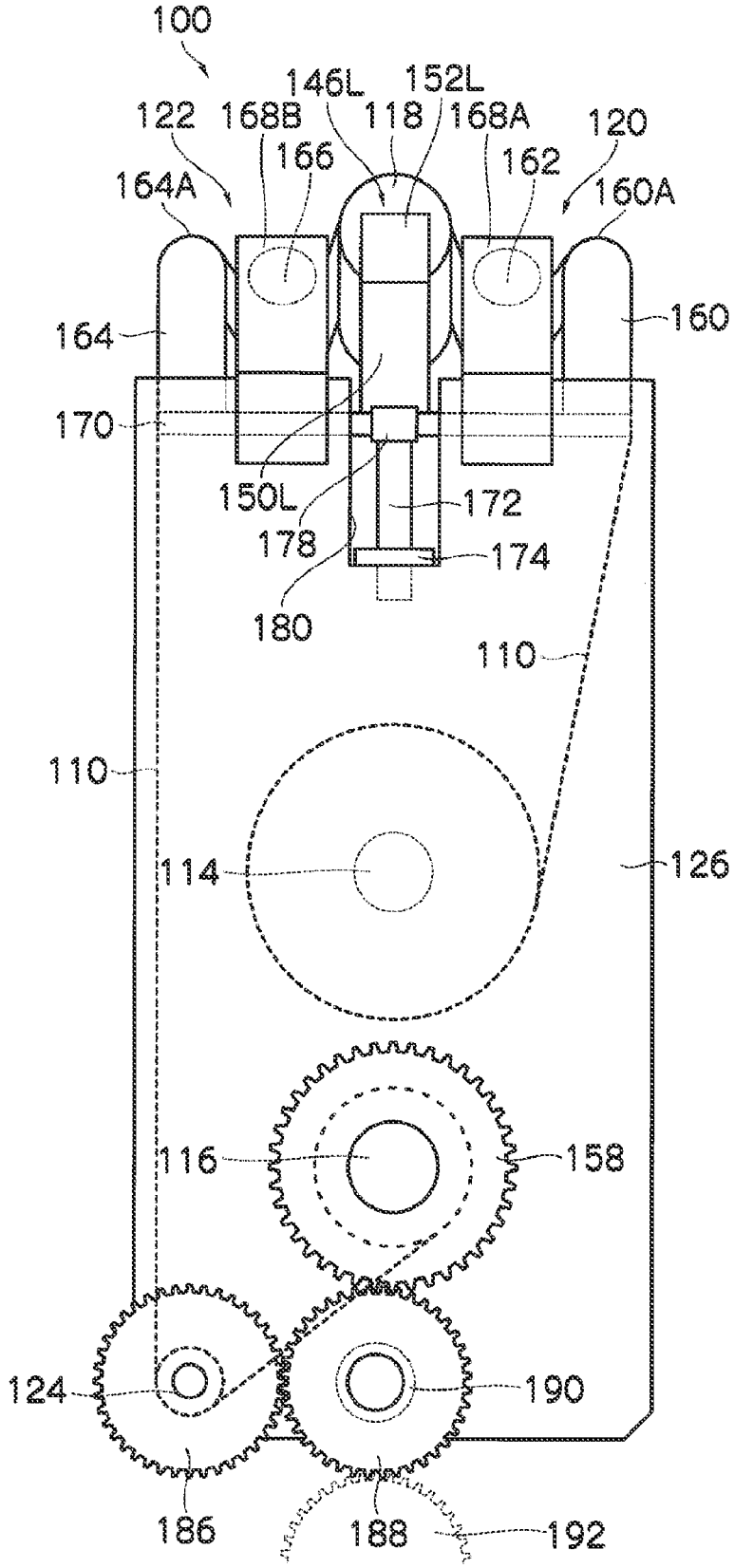
FIG. 7 is a rear view of the cleaner.

FIG. 4 is a plan diagram of the cleaner 100, FIG. 5 is a cross-sectional side view of the cleaner 100, FIG. 6 is a cross-sectional front view of the cleaner 100, and FIG. 7 is a rear face view of the cleaner 100.

As shown in FIGS. 4 to 7, the cleaner 100 has a wiping web 110 formed in a band shape, which is wrapped about a pressing roller 118 obliquely disposed, and the cleaner 100 wipes and cleans the nozzle surface of the line head by abutting and pressing the wiping web 110 wrapped about the pressing roller 118, against the nozzle surface of the line head.

The cleaner 100 includes: a case 112; a supply spindle 114, which supplies the wiping web 110; a take-up spindle 116, which takes up the wiping web 110; a front-stage guide 120, which guides the wiping web 110 supplied from the supply spindle 114 so as to be wrapped about the pressing roller 118; a rear-stage guide 122, which guides the wiping web 110 having been wrapped about the pressing roller 118 so as to be taken up onto the take-up spindle 116; and a drive roller 124, which drives the wiping web 110.

The case 112 is constituted of a base main body 126 and a lid 128. The case main body 126 is formed in a box shape, which is long in the vertical direction, and the upper end portion and the front face portion thereof are open. The lid 128 is attached to the front face portion of the case main body 126 with a hinge 130. The front face portion of the case main body 126 is opened and closed by means of the lid 128.

The lid 128 is provided with an elastically deformable locking hook 132, and the lid 128 is fixed to the case main body 126 by means of the locking hook 132, which elastically deforms and engages with a hook receiving section 134 formed on the case main body 126.

The supply spindle 114 is disposed so that the axis thereof is horizontal, and the base end portion thereof is rotatably supported on a bearing section 136, which is arranged in the case main body 126. A supply reel 138 having a flange 138*a* on the base end portion thereof is installed on the supply spindle 114. The supply reel 138 is fixed onto the supply spindle 114, and rotates in unison with the supply spindle 114.

As described below, the wiping web 110 which is wrapped in the form of a roll about a winding core 110A is installed on the supply spindle 114 by fitting the winding core 110A onto the supply reel 138.

The take-up spindle 116 is disposed so that the axis thereof is horizontal, at a position below the supply spindle 114. More specifically, the take-up spindle 116 is arranged below and parallel with the supply spindle 114. The vicinity of the base end portion of the take-up spindle 116 is rotatably supported on a bearing section 140, which is arranged in the case main body 126.

A take-up reel 142 having a flange 142*a* on the base end portion thereof is installed on the take-up spindle 116. A sliding member 144 is installed on the inner circumference of the axle portion of the take-up reel 142, and is composed so as to slide with respect to the take-up spindle 116 when a prescribed load or greater is applied in the direction of rotation.

As described below, a winding core 110B which is attached to the leading end of the wiping web 110 is installed on the take-up spindle 116 by fitting onto the take-up reel 142.

Furthermore, the take-up spindle 116 is arranged in such a manner that the base end portion thereof projects to the outer side of the case main body 126, and a take-up gear 158 is fixed to this projecting base end portion of the take-up spindle 116. The take-up spindle 116 is rotated by driving and rotating the take-up gear 158. The related drive system is described hereinafter.

The pressing roller 118 is disposed above the supply spindle 114 (in the present embodiment, the pressing roller 118, the supply spindle 114 and the take-up spindle 116 are disposed on the same straight line), and is arranged at a prescribed inclination with respect to the horizontal plane. In other words, the pressing roller 118 is disposed in accordance with the inclination of the nozzle surface of the line head that is to be cleaned (i.e., the axis of the pressing roller 118 is parallel with the nozzle surface) in order to abut and press the wiping web 110 against the nozzle surface of the line head.

The pressing roller 118 is provided with axle portions 118L and 118R, which project on either end portion thereof, and the axle portions 118L and 118R are supported by a pair of axle supporting sections 146L and 146R in a rotatable and swingable fashion.

Figure 8:
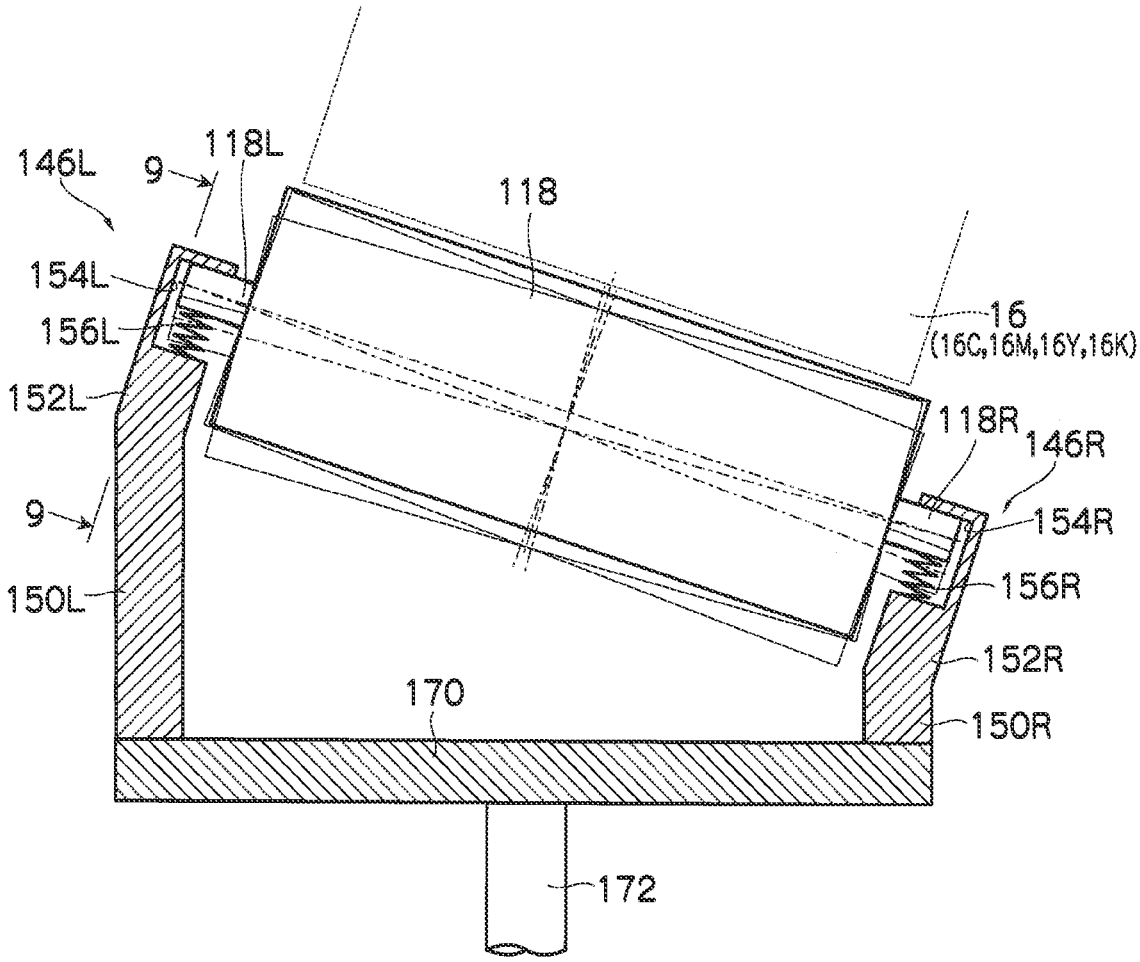
FIG. 8 is a cross-sectional partial front view showing the composition of a bearing section which supports an axle section of a pressing roller.
Figure 9:
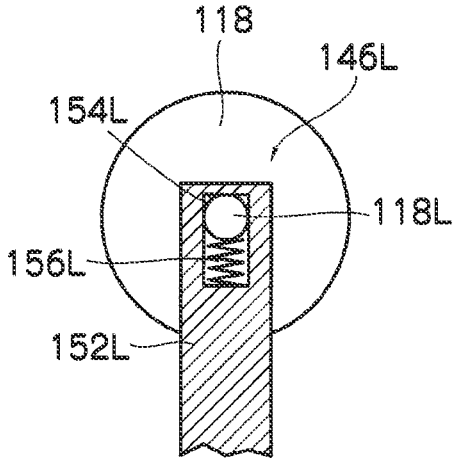
FIG. 9 is a cross-sectional view along line 9-9 in FIG. 8.

FIG. 8 is a partial cross-sectional front view diagram showing the composition of the axle supporting sections which support the axle sections 118L and 118R of the pressing roller 118, and FIG. 9 is a cross-sectional diagram along 9-9 in FIG. 8.

As shown in FIG. 8, the axle supporting sections 146L and the 146R are arranged on an elevator stage 170, which is horizontally disposed. The axle supporting sections 146L and 146R are constituted of pillar sections 150L and 150R, which are vertically erected on the stage 170, and supporting sections 152L and 152R, which are arranged in a bent fashion at the top ends of the pillar sections 150L and 150R.

The supporting sections 152L and 152R are arranged perpendicularly to the axle of the pressing roller 118, and recess sections 154L and 154R are formed in the inner sides thereof. Each of the recess sections 154L and 154R is formed in a rectangular shape, which has a breadth substantially equal to (slightly larger than) the diameter of each of the axle sections 118L and 118R of the pressing roller 118, and the lengthwise direction thereof is perpendicular to the nozzle surface of the line head that is to be cleaned (see FIG. 9). The axle sections 118L and 118R on either end of the pressing roller 118 are fitted freely into the recess sections 154L and 154R of the supporting sections 152L and 152R. Thus, the pressing roller 118 is supported swingably within the plane perpendicular to the nozzle surface of the line head that is to be cleaned.

Springs 156L and 156R are accommodated inside the recess sections 154L and 154R, and the axle sections 118L and 118R of the pressing roller 118 which are fitted freely inside the recess sections 154L and 154R are pressed upwards by the springs 156L and 156R. By this means, it is possible to cause the circumferential surface of the pressing roller 118 to make close contact with the nozzle surface, by following the nozzle surface of the line head that is to be cleaned.

The front-stage guide 120 is constituted of a first front-stage guide 160 and a second front-stage guide 162, and the wiping web 110 supplied from the supply spindle 114 is guided so as to wrap about the pressing roller 118, which is obliquely disposed.

On the other hand, the rear-stage guide 122 is constituted of a first rear-stage guide 164 and a second rear-stage guide 166, and the wiping web 110 which has been wrapped about the pressing roller 118 obliquely disposed is guided so as to be taken up onto the horizontally disposed take-up spindle 116.

The front-stage guide 120 and the rear-stage guide 122 are disposed symmetrically about the pressing roller 118. More specifically, the first front-stage guide 160 and the first rear-stage guide 164 are disposed symmetrically about the pressing roller 118, and furthermore the second front-stage guide 162 and the second rear-stage guide 166 are disposed symmetrically about the pressing roller 118.

The first front-stage guide 160 is formed in a plate shape having a prescribed width and is vertically erected on the elevator stage 170. The upper edge portion 160A of the first front-stage guide 160 is formed as a supporting section for the wiping web 110, and the surface thereof is formed in a circular arc shape. Furthermore, the upper edge portion 160A is formed at a prescribed angular inclination with respect to the horizontal plane, whereby the travel direction of the wiping web 110 is changed.

The first rear-stage guide 164 has the same composition as the first front-stage guide 160. More specifically, the first rear-stage guide 164 is formed in a plate shape having a prescribed width and is vertically erected on the elevator stage 170. The upper edge portion 164A is formed as a supporting section for the wiping web 110 and is formed in a circular arc shape. Furthermore, the upper edge portion 164A is formed at a prescribed angular inclination with respect to the horizontal plane.

The first front-stage guide 160 and the first rear-stage guide 164 are disposed symmetrically about the pressing roller 118. The travel direction of the wiping web 110 which has been supplied from the supply spindle 114 is changed to a direction substantially perpendicular to the axis of the pressing roller 118 from the direction perpendicular to the axis of the supply spindle 114, by wrapping the wiping web 110 about the first front-stage guide 160. The travel direction of the wiping web 110 having been wrapped about the second rear-stage guide 166 described below is changed to a direction perpendicular to the axis of the take-up spindle 116 by wrapping the wiping web 110 about the first rear-stage guide 164.

The second front-stage guide 162 is formed as a guide roller having flanges 162L and 162R on the respective end portions thereof. The second front-stage guide 162 is disposed between the first front-stage guide 160 and the pressing roller 118, and guides the wiping web 110 which has wrapped about the first front-stage guide 160 so as to be wrapped about the pressing roller 118. More specifically, the travel direction of the wiping web 110 which has been changed to the direction substantially perpendicular to the axis of the pressing roller 118 by the first front-stage guide 160 is slightly adjusted so that the wiping web 110 travels in the direction just perpendicular to the axis of the pressing roller 118. Furthermore, skewed travel of the wiping web 110 is prevented by the flange sections 162L and 162R on the respective ends of the first front-stage guide 160.

Figure 10:
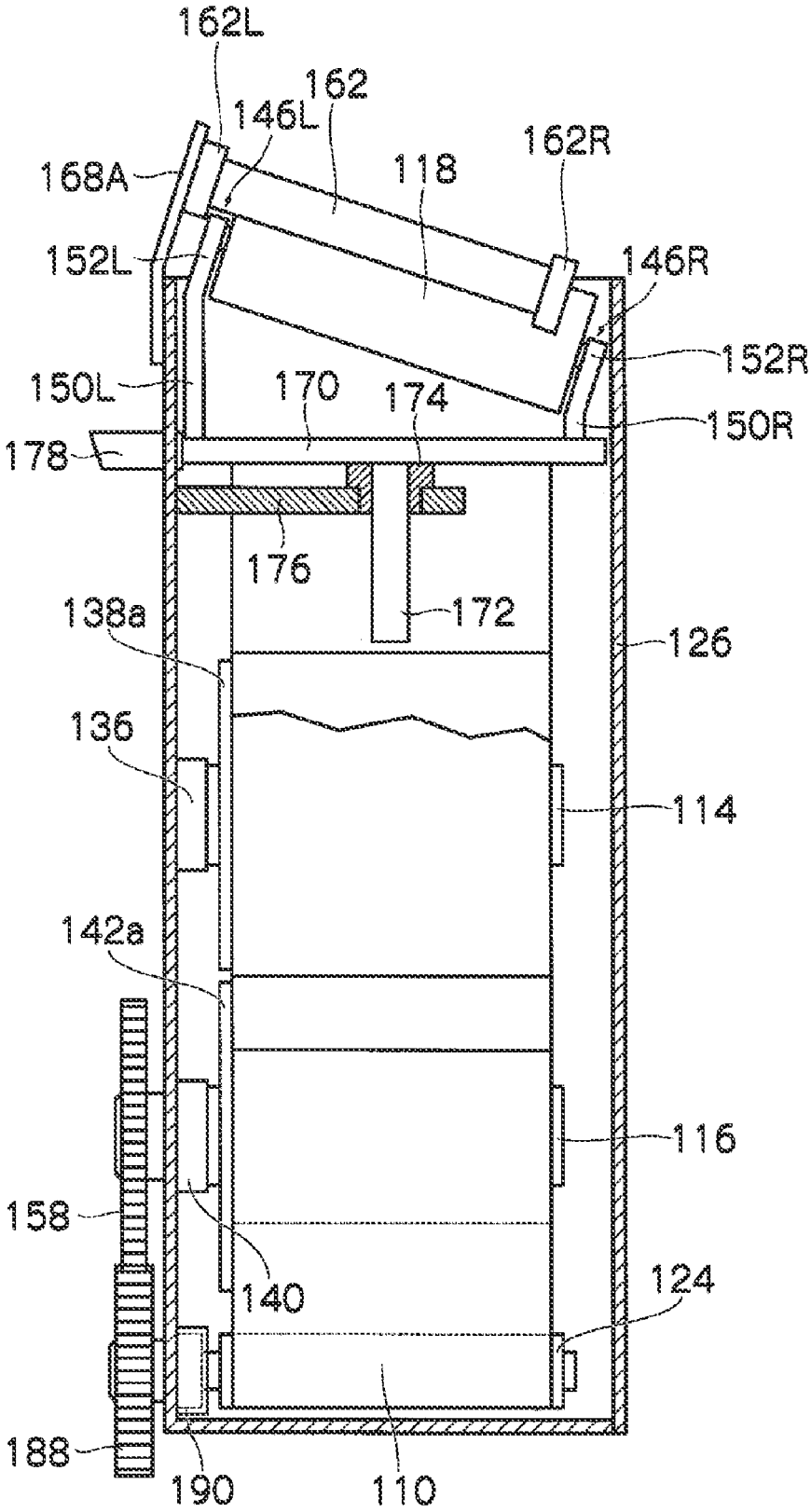
FIG. 10 is a cross-sectional view along line 10-10 in FIG. 6.

The second front-stage guide 162 is supported at only one end thereof on a bracket 168A, and the second front-stage guide 162 is disposed at a prescribed angular inclination. As shown in FIGS. 7 and 10, the bracket 168A is formed in a plate shape with a bent top end, and the base end portion of the bracket 168A is fixed to the upper end portion of the rear face of the case main body 126. The bracket 168A is arranged so as to project perpendicularly upwards from the upper end portion of the case main body 126. The second front-stage guide 162 is rotatably supported at only one end thereof on the bent portion of the top end of the bracket 168A.

The second rear-stage guide 166 has the same composition as the second front-stage guide 162. More specifically, the second rear-stage guide 166 is formed as a guide roller having flanges 166L and 166R on either end portion thereof, and the second rear-stage guide 166 is supported at only one end thereof on a bracket 168B. The second rear-stage guide 166 is arranged at a prescribed angular inclination. The bracket 168B is formed in a plate shape with a bent top end, and the base end portion of the bracket 168B is fixed to the upper end portion of the rear face of the case main body 126. The second rear-stage guide 166 is rotatably supported at only one end thereof on the bent portion of the top end of the bracket 168B.

The second rear-stage guide 166 is disposed between the pressing roller 118 and the first rear-stage guide 164, and guides the wiping web 110 which has been wrapped about the pressing roller 118 so as to be wrapped about the first rear-stage guide 164.

The second front-stage guide 162 and the second rear-stage guide 166 are disposed symmetrically about the pressing roller 118. The wiping web 110 of which the travel direction has been changed to the direction substantially perpendicular to the axis of the pressing roller 118 by the first front-stage guide 160 is wrapped about the second front-stage guide 162, whereby the travel direction of the wiping web 110 is slightly adjusted so that the wiping web 110 travels in the direction just perpendicular to the axis of the pressing roller 118. Furthermore, the travel direction of the wiping web 110 having been wrapped about the pressing roller 118 is slightly adjusted by the second rear-stage guide 166 so that the wiping web 110 can be wrapped about the first rear-stage guide 164. By wrapping the wiping web 110 about the first rear-stage guide 164, the travel direction of the wiping web 110 is changed to the direction perpendicular to the axis of the take-up spindle 116.

Thus, the front-stage guide 120 and the rear-stage guide 122 guide the wiping web 110 by gradually changing the travel direction of the wiping web 110, so that the wiping web 110 can be wrapped about the pressing roller 118 readily.

Consequently, the angle of inclination of the second front-stage guide 162 is closer to the angle of inclination of the pressing roller 118 than the angle of inclination of the first front-stage guide 160, and similarly, the angle of inclination of the second rear-stage guide 166 is closer to the angle of inclination of the pressing roller 118 than the angle of inclination of the first rear-stage guide 164.

As described above, the first front-stage guide 160, the pressing roller 118 and the first rear-stage guide 164 (the first structural body constituted of the first front-stage guide 160, the pressing roller 118 and the first rear-stage guide 164) are arranged on the elevator stage 170. The elevator stage 170 can be raised and lowered in the direction vertical to the horizontal plane.

As shown in FIG. 5, a guide shaft 172 is connected integrally with the elevator stage 170. The guide shaft 172 vertically extends downwards from the lower face of the elevator stage 170 and is fitted into a guide bush 174 disposed inside the case main body 126. The guide bush 174 is fixed to the inner wall face of the case main body 126 through a supporting member 176, and guides the guide shaft 172 perpendicularly with respect to the horizontal plane.

Figure 11A:
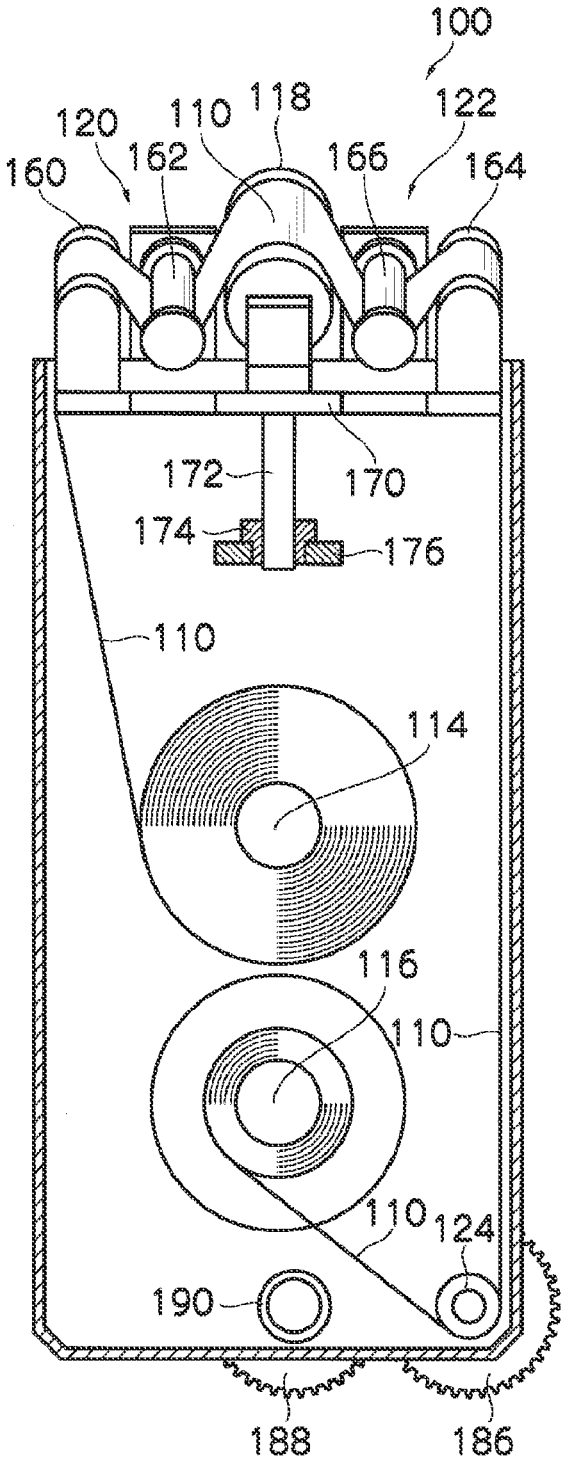
FIGS. 11A and 11B are illustrative diagrams showing the states of the wiping web in the cleaner, during use (FIG. 11A) and during replacement (FIG. 11B)
Figure 11B:
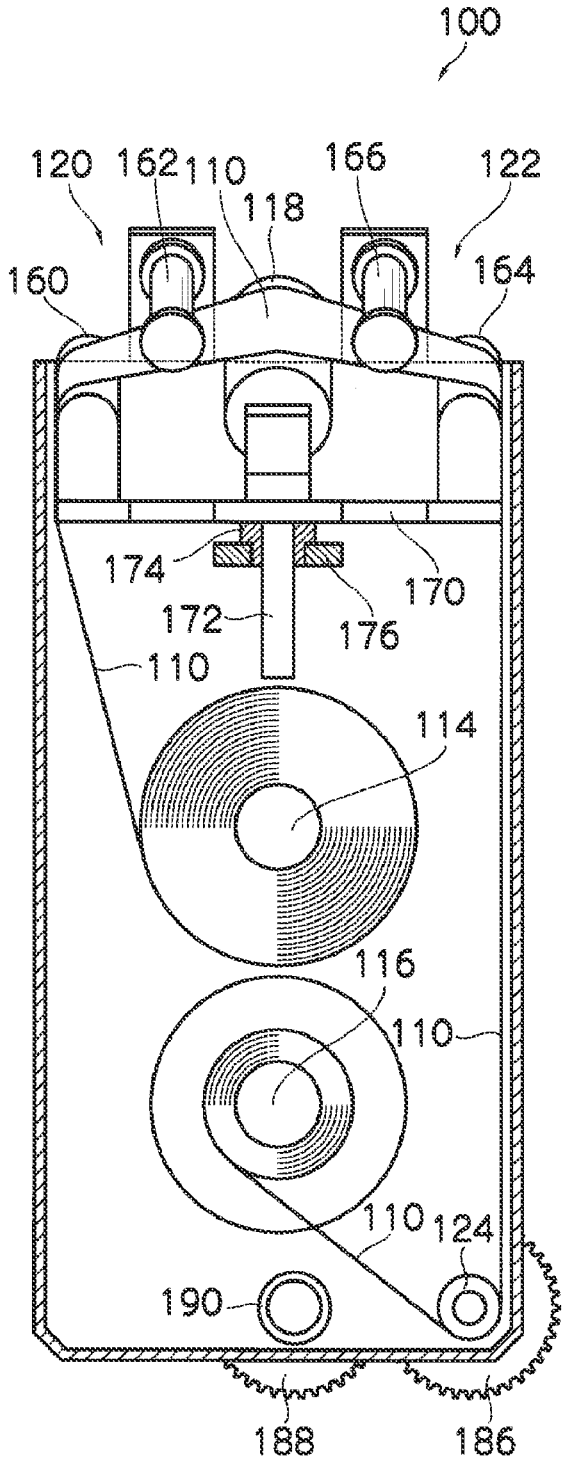

In this way, the elevator stage 170 on which the first front-stage guide 160, the pressing roller 118 and the first rear-stage guide 164 are disposed is arranged raisably and lowerably in the direction vertical to the horizontal plane. Therefore, as shown in FIGS. 11A and 11B, by raising and lowering the elevator stage 170, it is possible to cause the first front-stage guide 160, the pressing roller 118 and the first rear-stage guide 164 to advance and retreat with respect to the second front-stage guide 162 and the second rear-stage guide 166 (the second structural body constituted of the second front-stage guide 162 and the second rear-stage guide 166), which are fixedly arranged. By this means, it is possible to simply replace the wiping web 110.

More specifically, by lowering the elevator stage 170, as shown in FIG. 11B, the first front-side guide 160, the pressing roller 118 and the first rear-stage guide 164 can be retracted downwards with respect to the second front-stage guide 162 and the second rear-stage guide 166, and therefore a large space between same can be ensured. Thereby, it is possible to simply carry out the task of wrapping the wiping web 110 about the respective sections. Furthermore, the wiping web 110 can be simply wrapped about the respective sections by wrapping the wiping web 110 about the first front-stage guide 160, the pressing roller 118 and the first rear-stage guide 164, with the first front-stage guide 160, the pressing roller 118 and the first rear-stage guide 164 in the downwardly retracted state, and then raising the elevator stage 170. In other words, if the wiping web 110 is wrapped about the first front-stage guide 160, the pressing roller 118 and the first rear-stage guide 164, whereupon the elevator stage 170 is raised, as shown in FIG. 11A, then the wiping web 110 is automatically wrapped about the second front-stage guide 162 and the second rear-stage guide 166.

In this way, by making the first front-stage guide 160, the pressing roller 118 and the first rear-stage guide 164 capable of advancing and retracting with respect to the second front-stage guide 162 and the second rear-stage guide 166, it is possible to simply carry out the task of replacing the wiping web 110.

The first front-stage guide 160, the pressing roller 118 and the first rear-stage guide 164 need to be positioned in the prescribed use position (the position in FIG. 11A) when being used, and the first front-stage guide 160, the pressing roller 118 and the first rear-stage guide 164 are moved to the use position in coordination with the installation of the cleaner 100 on the rack 70.

This coordinated mechanism will now be described. As shown in FIGS. 5 and 7, an elevator lever (engagement section) 178 is arranged on the elevator stage 170, on which the first front-stage guide 160, the pressing roller 118 and the first rear-stage guide 164 are arranged. The elevator lever 178 is arranged so as to project from the rear face of the case main body 126 through a cutaway portion 180 formed on the rear face of the case main body 126. The elevator stage 170 is raised and lowered by sliding the elevator lever 178.

Figure 12A:
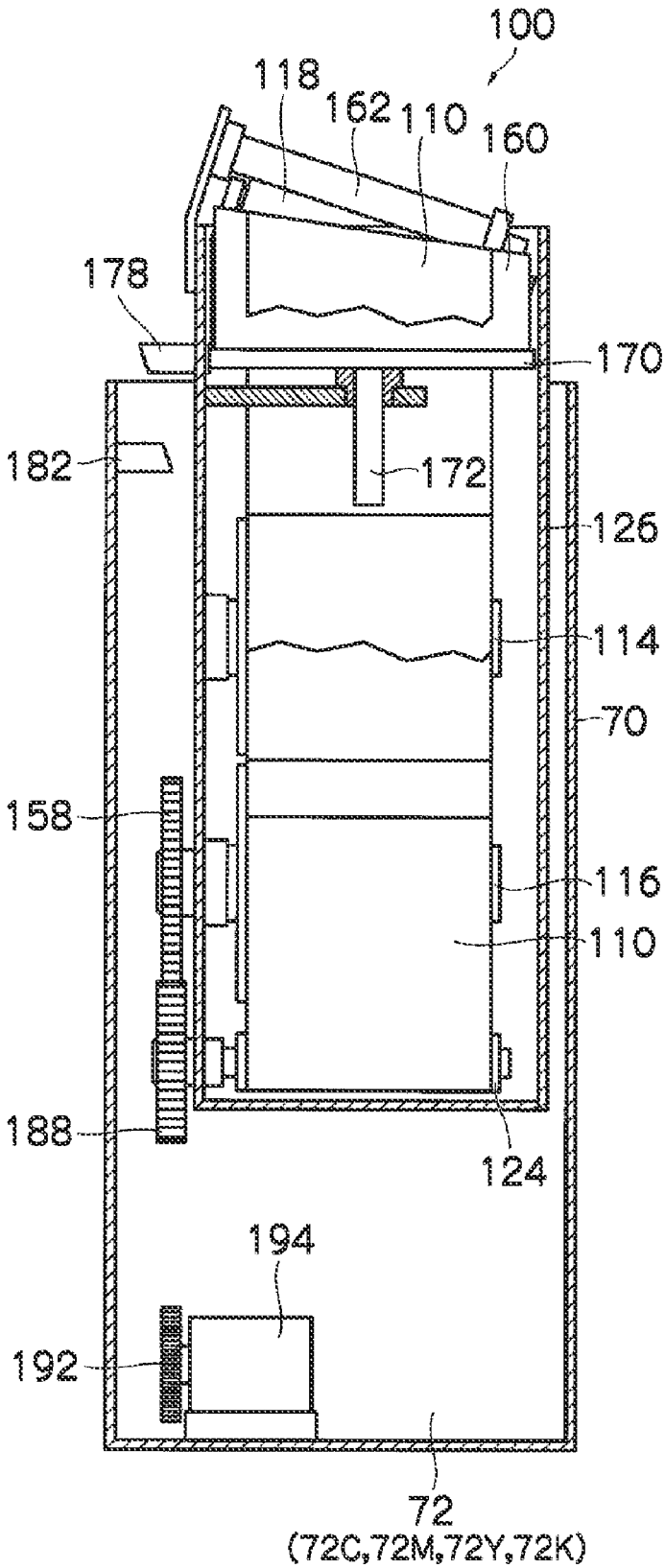
FIGS. 12A and 12B are illustrative diagrams of a coordination mechanism for raising and lowering an elevator stage.
Figure 12B:
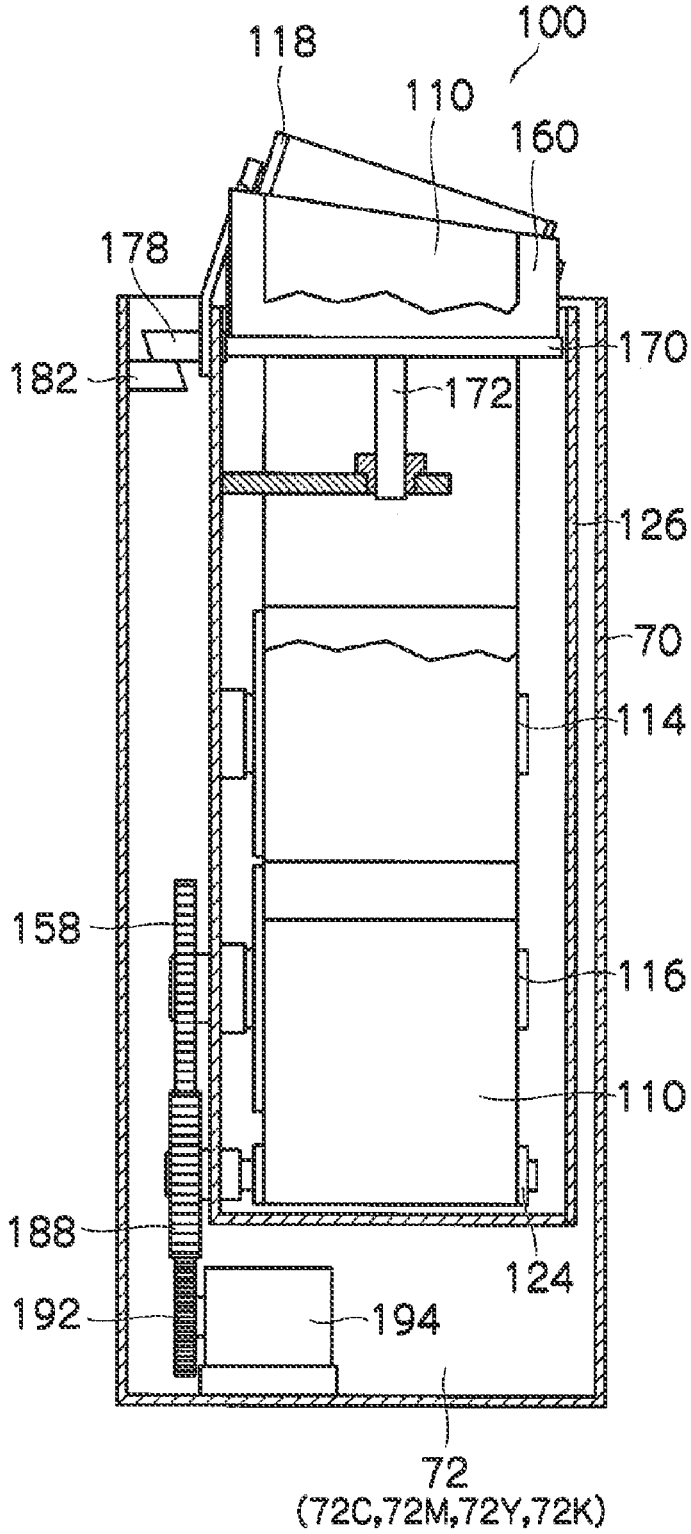

On the other hand, as shown in FIGS. 12A and 12B, a pin (engaging section) 182 is projectingly arranged on the inner side of the installation section 72 (72C, 72M, 72Y and 72K) of the rack 70 in which the cleaner 100 is set. The pin 182 is arranged so as to engage with the elevator lever 178 arranged on the cleaner 100 when the cleaner 100 is installed on the installation section 72.

According to the composition described above, as shown in FIGS. 12A and 12B, when the cleaner 100 is inserted into the installation section 72 of the rack 70, the elevator lever 178 engages with the pin 182 and is forcibly raised up to a prescribed position. Thereby, the first front-stage guide 160, the pressing roller 118 and the first rear-stage guide 164 are registered in the prescribed use position.

In this way, the first front-stage guide 160, the pressing roller 118 and the first rear-stage guide 164 are moved to the use position in coordination with the installation of the cleaner 100 on the rack 70.

The drive roller 124 is disposed in the vicinity of the base face of the case main body 126, in a position below the first rear-stage guide 164. The drive roller 124 drives and guides the wiping web 110 of which the travel direction has been changed to the direction perpendicular to the take-up spindle 116 by the first rear-stage guide 164, so that the wiping web 110 is taken up onto the take-up spindle 116.

The drive roller 124 is arranged in parallel with the take-up spindle 116 (namely in parallel with the horizontal plane), and the vicinity of the base end portion thereof is rotatably supported on a bearing section 184, which is arranged on the case main body 126.

Furthermore, the drive roller 124 is arranged in such a manner that the base end portion of the rotating shaft thereof projects to the outer side of the case main body 126, and a roller drive gear 186 is fixed to this projecting base end portion of the rotating shaft. The drive roller 124 is rotated by driving the roller drive gear 186 to rotate.

Here, the drive system of the cleaner 100 including the drive roller 124 will be described.

In the cleaner 100 according to the present embodiment, by driving the take-up spindle 116 to rotate while also driving the drive roller 124 to rotate, the wiping web 110 is caused to travel from the supply spindle 114 toward the take-up spindle 116.

As described above, the take-up gear 158 is fixed to the base end portion of the take-up spindle 116, and the roller drive gear 186 is fixed to the base end portion of the rotating shaft of the drive roller 124. As shown in FIG. 7, the take-up gear 158 and the roller drive hear 186 mesh with an idle gear 188.

The rotating shaft of the idle gear 188 is horizontally arranged and is rotatably supported on a bearing section 190 arranged on the case main body 126. The take-up gear 158 and the roller drive gear 186 are both caused to rotate in the same direction by driving the idle gear 188.

The idle gear 188 meshes with a drive gear 192 arranged inside the installation section 72 when the cleaner 100 is installed in the installation section 72 of the rack 70. More specifically, as shown in FIGS. 12A and 12B, a motor 194 forming a source of drive power is arranged in the base portion of the installation section 72, and the idle gear 188 meshes with the drive gear 192, which is fixed to the output shaft of the motor 194, when the cleaner 100 is installed in the installation section 72 of the rack 70.

In this way, the idle gear 188 meshes with the drive gear 192 arranged inside the installation section 72 when the cleaner 100 is installed in the installation section 72 of the rack 70. When the drive gear 192 is caused to rotate by the motor 194, the idle gear 188 rotates and this rotation of the idle gear 188 is transmitted to the roller drive gear 186 of the take-up gear 158, thereby rotating the take-up spindle 116 and the drive roller 124. Due to the rotation of the take-up spindle 116 and the driver roller 124, the wiping web 110 is supplied from the supply spindle 114, and taken up onto the take-up spindle 116 after passing along a prescribed path of travel.

As described above, the sliding member 144 is installed on the inner circumference of the axle portion of the take-up reel 142, which is installed on the take-up spindle 116, and the take-up reel 142 is composed so as to slide with respect to the take-up spindle 116 when the prescribed load or greater is applied in the direction of rotation. Consequently, the sliding member 144 slides if a velocity difference occurs between the take-up spindle 116 and the drive roller 124, and therefore allows the wiping web 110 to be conveyed at a uniform velocity at all times.

The cleaner 100 has the composition described above.

Action of Cleaner

Next, a method of cleaning a line head using the cleaner 100 according to the present embodiment having the aforementioned composition will be described.

<Installation of Wiping Web>

The method of installation the wiping web 110 on the cleaner 100 will be described.

The wiping web 110 is formed in a band shape having the prescribed width, and the winding cores 110A and 110B are attached respectively to either end thereof. The wiping web 110 is supplied in the form of a roll wound up onto the winding core 110A, one of the winding cores.

Firstly, the cleaner 100 is taken out from the rack 70 and the lid 128 of the case 112 is opened. Upon opening the lid 128, the supply reel 138 which is installed on the supply spindle 114 and the take-up reel 142 which is installed on the take-up spindle 116 are exposed, and then the winding cores 110A and 110B of the wiping web 110 are installed respectively on the supply reel 138 and the take-up reel 142. The winding cores 110A and 110B of the wiping web 110 are installed on the supply reel 138 and the take-up reel 142 while the wiping web 110 is being wrapped about the first front-stage guide 160, the pressing roller 118, the first rear-stage guide 164 and the drive roller 124.

More specifically, firstly, the winding core 110A on which the wiping web 110 is wound in the form of a roll is installed on the supply reel 138.

Thereupon, the wiping web 110 is unwound by a prescribed amount from the winding core 110A, passed below the second front-stage guide 162 and the second rear-stage guide 166, and also wrapped about the upper side of the first front-stage guide 160, the pressing roller 118 and the first rear-stage guide 164. At this time, the wiping web 110 is wrapped about the first front-stage guide 160, the pressing roller 118 and the first rear-stage guide 164 while the elevator stage 170 is in the lowered state, in other words, while the first front-stage guide 160, the pressing roller 118 and the first rear-stage guide 164 are in the downwardly retracted state. Thereby, it is possible to ensure sufficient space with respect to the second front-stage guide 162 and the second front-stage guide 166, and the wiping web 110 can be easily wrapped about the first front-stage guide 160, the pressing roller 118 and the first rear-stage guide 164 by passing below the second front-stage guide 162 and the second rear-stage guide 166.

The wiping web 110 wrapped about the first front-stage guide 160, the pressing roller 118 and the first rear-stage guide 164 is further wrapped about the drive roller 124, and finally the winding core 110B on the leading end thereof is installed on the take-up reel 142. Thus, installation of the wiping web 110 is completed. Thereafter, the wiping web 110 is wound back onto the winding core 110A as necessary, thereby eliminating slack in the wiping web 110, and the lid 128 of the case 112 is then closed.

<Setting in Rack>

Next, the cleaner 100 in which the wiping web 110 has been installed is set in the rack 70.

The cleaner 100 is set in the rack 70 by inserting the cleaner 100 perpendicularly into the installation section 72 formed in the rack 70.

When the cleaner 100 has been set in the installation section 72 of the rack 70, as shown in FIG. 12B, the idle gear 188 of the cleaner 100 meshes with the drive gear 192 arranged on the installation section 72, and thus becomes rotatably drivable by the motor 194, which is coupled to the drive gear 192.

Furthermore, when the cleaner 100 is set in the installation section 72 of the rack 70, the elevator lever 178 arranged on the elevator stage 170 engages with the pin 182 arranged on the installation section 72, and the elevator stage 170 is forcibly raised up to the prescribed position. Thereby, the first front-stage guide 160, the pressing roller 118 and the first rear-stage guide 164 are registered in the prescribed use position. By registering the first front-stage guide 160, the pressing roller 118 and the first rear-stage guide 164 in the prescribed use position, the wiping web 110 becomes wrapped about the second front-stage guide 162, which is disposed between the first front-stage guide 160 and the pressing roller 118, and furthermore the wiping web 110 also becomes wrapped about the second rear-stage guide 166, which is disposed between the pressing roller 118 and the first rear-stage guide 164. Thereby, the wiping web 110 is tautly wrapped about the circumferential surface of the pressing roller 118.

Thus, the setting of the cleaner 100 in the rack 70 is completed.

In the thus set cleaner 100 in the rack 70, by driving the motor 194, the wiping web 110 is supplied from the supply spindle 114 and taken up onto the take-up spindle 116 after passing along a prescribed path of travel.

Furthermore, as shown in FIG. 3, the pressing rollers 118 of cleaners 100C, 100M, 100Y and 100K, which correspond respectively to the line heads 16C, 16M, 16Y and 16K disposed with their nozzle surfaces 30C, 30M, 30Y and 30K at the inclinations with respect to the horizontal plane, are positioned in parallel with the nozzle surfaces 30C, 30M, 30Y and 30K, respectively. Thus, it is possible to cause the wiping webs 110 wrapped about the respective pressing rollers 118 to make tight contact with the corresponding nozzle surfaces 30C, 30M, 30Y and 30K.

<Cleaning Operation>

When the line heads 16C, 16M, 16Y and 16K are moved from the image formation position to the maintenance position, the wiping webs 110 are abutted and pressed against the nozzle surfaces 30C, 30M, 30Y and 30K of the line heads 16C, 16M, 16Y and 16K, and the nozzle surfaces 30C, 30M, 30Y and 30K are thereby wiped and cleaned. More specifically, the nozzle surfaces are cleaned as follows.

As stated previously, the head cleaning unit 60 is supported on the elevator device and can be raised and lowered in the direction vertically to the horizontal surface. Normally, the head cleaning unit 60 waits in a prescribed standby position.

Firstly, the line heads 16C, 16M, 16Y and 16K are moved through a prescribed amount from the image formation position toward the maintenance position. Thereby, the end portions of the line heads 16C, 16M, 16Y and 16K on the side of the maintenance position are situated above the head cleaning unit 60 which is disposed in the standby position.

When the line heads 16C, 16M, 16Y and 16K are halted, the head cleaning unit 60 is raised by a prescribed amount from the standby position. Thereby, the wiping webs 110 wrapped about the pressing rollers 118 are respectively abutted and pressed against the nozzle surfaces 30C, 30M, 30Y and 30K of the line heads 16C, 16M, 16Y and 16K.

As stated previously, the pressing rollers 118 are supported swingably with the springs 156L and 156R, and it is then possible to cause the wiping webs 110 to make close contact with the nozzle surfaces 30C, 30M, 30Y and 30K, following the inclinations of the nozzle surfaces 30C, 30M, 30Y and 30K, even if the pressing rollers 118 are not disposed completely in parallel with the nozzle surfaces 30C, 30M, 30Y and 30K.

When the head cleaning unit 60 has been raised by the prescribed amount and the wiping webs 110 wrapped about the pressing rollers 118 are abutted and pressed against the nozzle surfaces 30C, 30M, 30Y and 30K, then the motors 194 of the cleaners 100C, 100M, 100Y and 100K are driven. Thereby, the wiping webs 110 abutted and pressed against the nozzle surfaces 30C, 30M, 30Y and 30K are caused to travel.

When the wiping webs 110 start to travel, the line heads 16C, 16M, 16Y and 16K start to be moved at a prescribed movement speed toward the maintenance position. Thereby, the nozzle surfaces 30C, 30M, 30Y and 30K are wiped and cleaned by the travelling wiping webs 110.

The line heads 16C, 16M, 16Y and 16K are halted upon arriving at the maintenance position, and thereby the nozzle surfaces 30C, 30M, 30Y and 30K are completely wiped and cleaned by the wiping webs 110.

When the line heads 16C, 16M, 16Y and 16K arrive at the maintenance position, the driving of the motors 194 is halted, and the travel of the wiping webs 110 is halted.

Thereupon, the head cleaning unit 60 is lowered by the prescribed amount and thereby retracted to the prescribed standby position.

Thus, when the line heads 16C, 16M, 16Y and 16K are moved from the image formation position to the maintenance position, the wiping webs 110 are abutted and pressed against the nozzle surfaces 30C, 30M, 30Y and 30K of the line heads 16C, 16M, 16Y and 16K, and the nozzle surfaces 30C, 30M, 30Y and 30K are thereby wiped and cleaned.

As described above, in the inkjet recording apparatus according to the present embodiment, of the cleaners 100C, 100M, 100Y and 100K, which clean the nozzle surfaces 30C, 30M, 30Y and 30K, only the portions corresponding to the pressing rollers 118 are inclined in accordance with the nozzle surfaces 30C, 30M, 30Y and 30K. Thereby, even if the nozzle surfaces 30C, 30M, 30Y and 30K are obliquely disposed, it is not necessary to obliquely arrange the cleaners as a whole, and the required installation space (the space in the front-rear direction of the line heads 16C, 16M, 16Y and 16K, which is the lateral direction in FIG. 1) can be made more compact. This is especially effective in a case where the line heads 16C, 16M, 16Y and 16K are disposed at a uniform spacing apart about the periphery of the image formation drum 14, as in the inkjet recording apparatus according to the present embodiment.

Furthermore, according to the cleaner of the present embodiment, even if the winding diameter of the wiping web 110 is large, the required installation space (the space in the front-rear direction of the line heads 16C, 16M, 16Y and 16K) does not change, and therefore the winding diameter of the wiping web 110 can be made larger (i.e., the length of the wiping web 110 can be made longer). Thereby, it is also possible to reduce the frequency of replacement of the wiping web 110.

In the present embodiment, the front-stage guide 120 is constituted of the first front-stage guide 160 and the second front-stage guide 162, and the rear-stage guide 122 is constituted of the first rear-stage guide 164 and the second rear-stage guide 166; however, it is also possible to compose these guides by a larger number of guide members. In this case, it is desirable to achieve a composition for gradually changing the travel direction of the wiping web 110 and wrapping the wiping web 110 about the pressing roller 118 by composing the angles of inclination of the guide members gradually approaching the angle of inclination of the pressing roller.

By composing the front-stage guide 120 by the first front-stage guide 160 and the second front-stage guide 162 and composing the rear-stage guide 122 by the first rear-stage guide 164 and the second rear-stage guide 166, as in the cleaner according to the present embodiment, it is possible to wrap the wiping web 110 readily about the pressing roller 118 which is obliquely disposed, by means of a minimum necessary number of guide members.

Although the first front-stage guide 160, the pressing roller 118 and the first rear-stage guide 164 in the present embodiment can be raised and lowered, it is also possible that they are fixed.

Moreover, although the first front-stage guide 160, the pressing roller 118 and the first rear-stage guide 164 in the present embodiment are composed movably with respect to the second front-stage guide 162 and the second rear-stage guide 166, which are fixed, it is also possible to adopt a composition in which the first front-stage guide 160, the pressing roller 118 and the first rear-stage guide 164 are fixed and the second front-stage guide 162 and the second rear-stage guide 166 can be raised and lowered.

Moreover, the first front-stage guide 160, the pressing roller 118 and the first rear-stage guide 164 in the present embodiment are moved to the prescribed use position in coordination with the installation of the cleaner on the rack, and it is also possible to provide a device that fixes the first front-stage guide 160, the pressing roller 118 and the first rear-stage guide 164 in the prescribed use position. For example, it is possible to provide a device which locks the elevator stage 170 to the case main body 126 in such a manner that the first front-stage guide 160, the pressing roller 118 and the first rear-stage guide 164 are fixed in the prescribed use position by locking the elevator stage 170 by means of the locking device.

Further, the first front-stage guide 160, the pressing roller 118 and the first rear-stage guide 164 in the present embodiment are retracted downwards during replacement of the wiping web 110, and it is also possible to provide a device which locks the elevator stage 170 in the retracted state. Thereby, it is possible to replace the wiping web 110 even more simply.

Further, although the first front-stage guide 160 and the first rear-stage guide 164 in the present embodiment are formed in the shape of plates having the prescribed width, it is also possible that the first front-stage guide 160 and the first rear-stage guide 164 are constituted of guide rollers, similarly to the second front-stage guide 162 and the second rear-stage guide 166.

Furthermore, although the present invention is described with respect to the embodiment of cleaning the nozzle surfaces of line heads in the present embodiment, it is also possible to apply the present invention to a case of cleaning the nozzle surfaces of shuttle scanning type heads.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

an inkjet head having a nozzle surface in which inkjet nozzles are arranged, the nozzle surface being oblique to a horizontal plane; and a cleaner which wipes the nozzle surface and includes:

a supply spindle and a take-up spindle of which axes are horizontal;

a band-shaped wiping member which is wound in a form of a roll and installed on the supply spindle, travels along a prescribed path of travel and is taken up onto the take-up spindle;

a pressing roller of which axis is arranged in parallel with the nozzle surface and in oblique to the horizontal axes of the supply spindle and the take-up spindle, the wiping member being wrapped about a circumferential surface of the pressing roller;

a front-stage guide device which is disposed between the supply spindle and the pressing roller and guides the wiping member supplied from the supply spindle so as to travel in a direction perpendicular to the axis of the pressing roller which is oblique to the horizontal plane; and a rear-stage guide device which is disposed between the pressing roller and the take-up spindle and guides the wiping member wrapped about the pressing roller so as to travel in a direction perpendicular to the horizontal axis of the take-up spindle, wherein the nozzle surface is cleaned by abutting the wiping member wrapped about the pressing roller against the nozzle surface.

2. The inkjet recording apparatus as defined in claim 1, wherein the pressing roller is supported swingably within a plane perpendicular to the nozzle surface and follows the nozzle surface when abutted against the nozzle surface.

3. The inkjet recording apparatus as defined in claim 1, wherein:

the front-stage guide device includes a plurality of front-stage guide members about which the wiping member is wrapped, and guides the wiping member supplied from the supply spindle so as to travel in the direction perpendicular to the axis of the pressing roller while gradually changing a travel direction of the wiping member by the front-stage guide members, and the rear-stage guide device includes a plurality of rear-stage guide members about which the wiping member is wrapped, and guides the wiping member wrapped about the pressing roller so as to travel in the direction perpendicular to the axis of the take-up spindle while gradually changing the travel direction of the wiping member by the rear-stage guide members.

4. The inkjet recording apparatus as defined in claim 3, wherein:

the front-stage guide device includes:

a first front-stage guide member, about which the wiping member is wrapped, and which changes the travel direction of the wiping member from a direction perpendicular to the axis of the supply spindle to a direction substantially perpendicular to the axis of the pressing roller; and a second front-stage guide member which is disposed between the first front-stage guide member and the pressing roller and guides the wiping member so as to wrap about the first front-stage guide member and the pressing roller, and the rear-stage guide device includes:

a first rear-stage guide member, about which the wiping member is wrapped, and which changes the travel direction of the wiping member from a direction substantially perpendicular to the axis of the pressing roller to the direction perpendicular to the axis of the take-up spindle; and a second rear-stage guide member which is disposed between the first rear-stage guide member and the pressing roller and guides the wiping member so as to wrap about the first rear-stage guide member and the pressing roller.

5. The inkjet recording apparatus as defined in claim 4, wherein the second front-stage guide member is constituted of a guide roller having flanges, and skewed travel of the wiping member is prevented by engagement of edge portions of the travelling wiping member with the flanges.

6. The inkjet recording apparatus as defined in claim 4, wherein the second rear-stage guide member is constituted of a guide roller having flanges, and skewed travel of the wiping member is prevented by engagement of edge portions of the travelling wiping member with the flanges.

7. The inkjet recording apparatus as defined in claim 4, wherein:

a first structural body including the first front-stage guide member, the pressing roller and the first rear-stage guide member is arranged so as to be movable in a vertical direction relatively to a second structural body including the second front-stage guide member and the second rear-stage guide member; and the first structural body is arranged retractably to a prescribed retracted position from a prescribed use position with respect to the second structural body.

8. The inkjet recording apparatus as defined in claim 7, further comprising:

a rack which accommodates the cleaner and is set at a prescribed position in a main body of the inkjet recording apparatus, wherein when the cleaner is installed into the rack, an engaging section arranged in the rack engages with an engaged section linked to the first structural body to forcibly position the first structural body in the prescribed use position.

9. The inkjet recording apparatus as defined in claim 8, wherein:

the take-up spindle is coupled to a gear; and when the cleaner is installed in the rack, the gear of the take-up spindle engages with a drive gear arranged inside the rack and is caused to rotate by receiving drive force from the drive gear.

10. The inkjet recording apparatus as defined in claim 1, wherein the supply spindle and the take-up spindle are disposed in parallel, one above the other, in positions vertically below the pressing roller.

11. The inkjet recording apparatus as defined in claim 1, further comprising:

a drum which conveys a recording medium by rotation, wherein the inkjet head is disposed at a periphery of the drum, and the nozzle surface is then arranged obliquely to the horizontal plane.

12. The inkjet recording apparatus as defined in claim 1, wherein the wiping member is wound on a winding core in the form of the roll, is installed on the supply spindle by mounting the winding core on the supply spindle, and is taken up onto a winding core which is mounted on the take-up spindle.

* * * * *